US006199536B1

(12) United States Patent
Flinspach et al.

(10) Patent No.: US 6,199,536 B1
(45) Date of Patent: Mar. 13, 2001

(54) METHODS FOR AVOIDING BUCKING OSCILLATIONS DURING ACCELERATION OF VEHICLES

(75) Inventors: Roland Flinspach, Wiernsheim; Andreas Haller, Stuttgart; Franz Moser, Hochdorf; Günter Rink, Lauterstein, all of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/302,113

(22) Filed: Apr. 29, 1999

(30) Foreign Application Priority Data

Apr. 29, 1998 (DE) ..... 198 19 049

(51) Int. Cl.[7] ..... F02D 9/10
(52) U.S. Cl. ..... 123/399
(58) Field of Search ..... 123/492, 493, 123/682, 406.25, 406.46, 406.5, 370, 371, 399

(56) References Cited

U.S. PATENT DOCUMENTS

| | | | | |
|---|---|---|---|---|
| 4,543,933 | * | 10/1985 | Kessler et al. | 123/361 |
| 4,844,026 | * | 7/1989 | Tomisawa | 123/406.25 |
| 4,919,098 | * | 4/1990 | Shimada et al. | 123/406.46 |
| 5,070,841 | * | 12/1991 | Fujimoto et al. | 123/406.46 |
| 5,101,786 | * | 4/1992 | Kamio et al. | 123/492 |
| 5,522,366 | * | 6/1996 | Konno et al. | 123/492 |
| 5,532,929 | | 7/1996 | Hattori et al. | 364/431.07 |

FOREIGN PATENT DOCUMENTS

| | | |
|---|---|---|
| 3738719 C2 | 11/1987 | (DE) . |
| 4013943 C2 | 4/1990 | (DE) . |
| 42 02 407 A1 | 1/1992 | (DE) . |
| 42 23 520 A1 | 7/1992 | (DE) . |
| 43 12 336 A1 | 4/1993 | (DE) . |
| 79371 | 9/1991 | (JP) . |
| 141375 | 11/1997 | (JP) . |
| 40045 | 7/1998 | (JP) . |

* cited by examiner

*Primary Examiner*—Erick Solis
(74) *Attorney, Agent, or Firm*—Roland A. Fuller, III

(57) ABSTRACT

In a method to avoid bucking oscillations during acceleration of vehicles the throttle valve position is influenced, in which, for conversion of engine torque trend between the lower torque initial value and an upper torque target value, the trend of the throttle valve position is changed between an initial closed position corresponding to the torque initial value and a target opening position corresponding to the torque target value.

To prevent bucking oscillations reliably without adversely affecting the acceleration behavior and exhaust behavior, the trend of the throttle valve position adjacent to the initial closed position has a local maximum that opens the throttle valve and a local minimum that closes the throttle valve between the local maximum and the target opening position.

9 Claims, 2 Drawing Sheets

METHODS FOR AVOIDING BUCKING OSCILLATIONS DURING ACCELERATION OF VEHICLES

The invention concerns a method to avoid bucking oscillations during acceleration of vehicles according to the preamble of claim 1.

BACKGROUND

Bucking oscillations are vehicle longitudinal oscillations caused by introduction of energy into the engine-drive train-body oscillation system, especially during acceleration of the vehicle. The engine torque is transferred to the drive train via a flywheel, which acts as a torsion spring and must initially be distorted under the influence of the engine torque. If this occurs from a rapid torque buildup, overshooting of the flywheel occurs because of the kinetic energy stored in the flywheel, which manifests itself in the aforementioned category of bucking oscillations.

Measures can be taken to avoid bucking oscillations via which the engine torque is influenced in phase-directed fashion so that the longitudinal oscillations of the vehicle are prevented. Ignition angle adjustment, interventions in the fuel injection or deliberate influencing of throttle valve movement are considered as such measures. In the latter the gas pedal movement is ordinarily converted in attenuated fashion to movement of the throttle valve so that the throttle valve is opened with lower speed or time-delayed relative to gas pedal movement. In this procedure the bucking oscillations are reduced, but at the same time the response of the vehicle significantly deteriorates.

The problem underlying the invention is to prevent bucking oscillations reliably without adversely affecting acceleration behavior and exhaust behavior.

This problem is solved according to the inventions with the features of claim 1.

SUMMARY

To accelerate the vehicle free of bucking, a specific engine torque trend that prevents bucking oscillations is converted by changing the throttle valve setting according to a stipulated function. This type of engine torque trend is achieved in that the trend of the throttle valve setting, starting from an initial closed position, is initially increased briefly to a local maximum, in which the throttle valve is opened. The throttle valve is then moved back to the closed position according to the local minimum in the throttle valve function and finally the target opening position is opened accordingly until the target torque value is reached. The trend of the throttle valve function is essentially independent of the trend of gas pedal movement.

Right after activation of the gas pedal, the throttle valve is acted upon according to the throttle valve function so that dead times between gas pedal movement and throttle valve movement are virtually avoided. An optimized engine torque trend is simulated by the rise to a local maximum and the subsequent fall to a local minimum, during which the drive train is excited by the application of a torque pulse in the prestress direction, oscillates further to the reversal point of the oscillation excursion during the local minimum and is exposed at the reversal point to the target torque value at full prestress. In this manner acceleration free of bucking with almost maximum possible agility can be obtained.

Another advantage lies in the fact that because of brief opening of the throttle valve in the region of the local maximum of the throttle valve trend, a rapid, delay-free filling of the intake tube of the internal combustion engine with intake air is made possible. Moreover, by direct driving of the throttle valve in the region of the local maximum, delays as a result of attenuated conversion of the gas pedal movement and, as a result, inertia of engine and control components, are avoided.

Adjustment of the throttle valve expediently occurs by an electrically operable control element, which is exposed to a current function through which the desired trend of the throttle valve setting is produced. The current function is advantageously designed as a roughly rectangular fiction with time-discrete current intervals that can be simply generated.

The current function preferably has an irregularity with which the local maximum in the trend of the throttle valve setting is simulated and which is designed as a brief rectangular pulse with high amplitude. The irregularity causes a very brief, partial opening of the throttle valve so that a significant rise in intake pressure and engine torque can be achieved. Because of this, the maximum vehicle acceleration is reached in the shortest possible time. 100% current of the throttle valve for 20 ms is already sufficient to open the throttle valve 20% and to achieve 50% of the maximum intake pressure, in which the maximum vehicle acceleration occurs free of bucking after about 180 ms.

In order to achieve the torque fiction responsible for startup free of bucking via the throttle valve setting, the time intervals of the different phases within the throttle valve function can be adjusted to the oscillation period of the bucking oscillation. The time interval between the initial closed position and the target opening position of the throttle valve expediently amounts to about ¼ to ½ of the oscillation time of the bucking oscillation, in which the precise value of this time interval depends on the amplitude and duration of the local maximum in the throttle valve function. If the local maximum is produced roughly as a Dirac pulse, the time interval for distortion of the drive train and bucking-free application of the target torque is reduced to ¼. If, on the other hand, the throttle valve function is stipulated in an easy to accomplish manner as a roughly sloped, continuous torque trend between the local maximum, the local minimum and the target torque value, the time interval rises to ½ of the oscillation period of the bucking oscillation.

In order to recognize an acceleration intention with reference to a gas pedal activation caused by the driver, the speed of the gas pedal is detected and a throttle valve change is preferably triggered for a case in which the gas pedal speed lies above a threshold value that can be determined as a function of different parameters, for example, as a function of the initial position of the gas pedal, the path difference between the initial position and the end position of the gas pedal, the engine speed and the presently engaged gear.

BRIEF DESCRIPTION OF THE DRAWINGS

Additional advantages and expedient variants can be gathered from the additional claims, the description of the figure and the drawings. In the drawings:

DETAILED DESCRIPTION

The graphs depicted in FIGS. 1 to 5 each show three function trends, one trend for rapid acceleration (solid line), one trend for slower acceleration to the same target level (dash-dot line) and one trend for an acceleration to a lower target level (dashed line).

Figure 1:
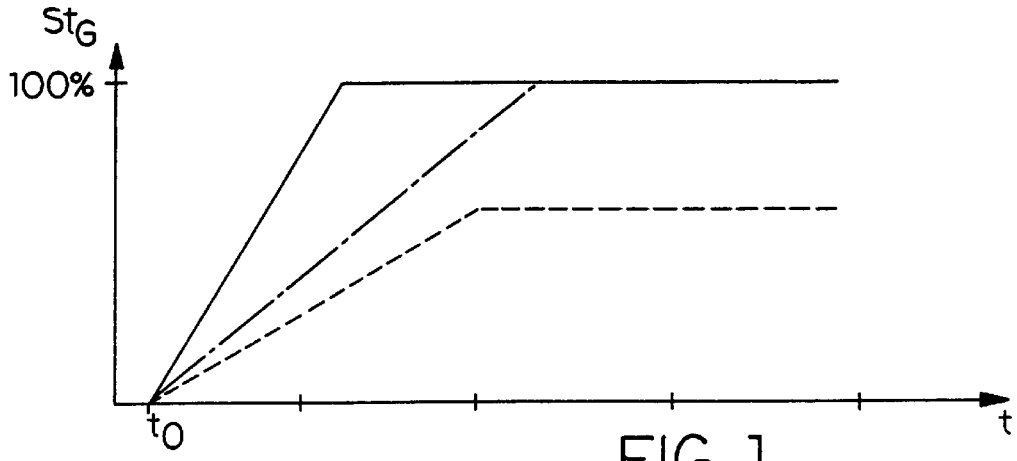
FIG. 1 shows the trend of the gas pedal position.

According to FIG. 1 the change in gas pedal position $St_G$ in the depicted example has a linear sloped trend, starting from an initial position in which the gas pedal is not acted on, to an end position in which the gas pedal is pressed down by the driver to a maximum value of 100%. In the solid line function, the gas pedal change triggered to time to has the greatest gradient so that the end position with a maximum value of 100% is reached fastest. In the dash-dot function, the rise is flatter and the final value also amounts to 100%. The dashed function shows the flattest rise with an end value that is clearly below 100%.

Figure 2:
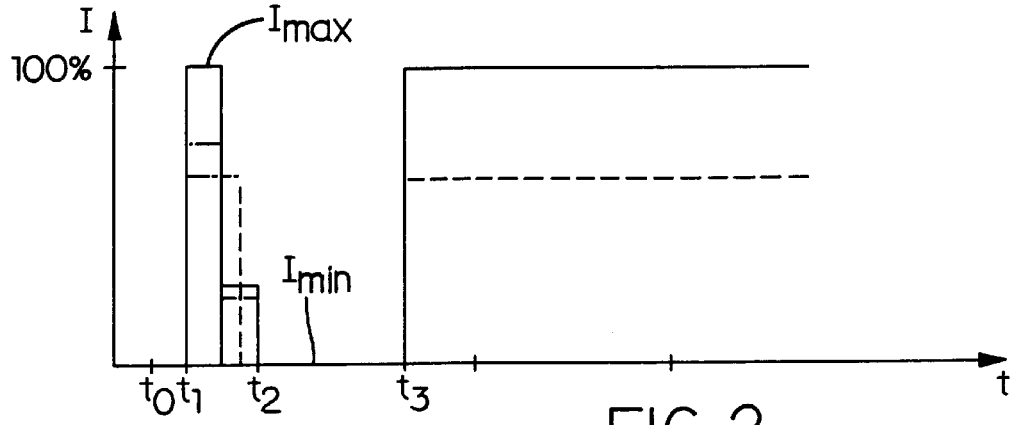
FIG. 2 shows the trend of the current function of the control element of the throttle valve.

The position $St_G$ of the gas pedal depicted in FIG. 1 is converted to a current function I depicted in FIG. 2, which represents the current trend of an electrical control element via which the throttle valve of the internal combustion engine is adjusted. The current function I, which is designed as a rectangular fimction, begins with a slight time delay at time $t_1$ and rises abruptly to a local maximum $I_{max}$. In the solid trend the level of the local maximum initially drops to a distinct lower stage and then falls to time $t_2$ to a local minimum $I_{min}$, which is zero in the practical example. At time $t_3$ the current intensity again rises abruptly to an end level corresponding to the position of the gas pedal.

In the current functions corresponding to the flat gas pedal positions, the maximum of current intensity lies at a lower level (dash-dot line). The time interval for the rectangular pulse can optionally also be varied, especially shortened.

It can be expedient to stipulate only a rectangular pulse for the current fiction whose amplitude is reduced as shown by the dashed line and extends over a longer time interval.

The local maximum $I_{max}$ is sent as current pulse to the control element so that a brief, partial movement of the throttle valve is caused. Because of this, rapid filling of the intake with a rapid pressure rise is achieved.

The local maximum $I_{max}$ is sent with a short time delay at time $t_1$ relative to the beginning of the rise in gas pedal position at time $t_0$. In this time interval the parameters that determine the trend of the current function and thus the trend of the throttle valve position can be established by measurement and evaluation devices. A change of throttle valve position is expediently triggered by acting on the control element with the current function, when the change in gas pedal position, and consequently the speed of the gas pedal, lies above a threshold value which is determined from the initial position of the gas pedal, the gas pedal path difference, the engine speed and/or the gear position. From these parameters the initial trend of the current fiction, especially the trend of the local maximum $I_{max}$ and the local minimum $I_{min}$, can initially be determined. The end level of the current function and the throttle valve position can be established from additional cyclically recorded measurements at a later time lying after $t_2$.

Figure 3:
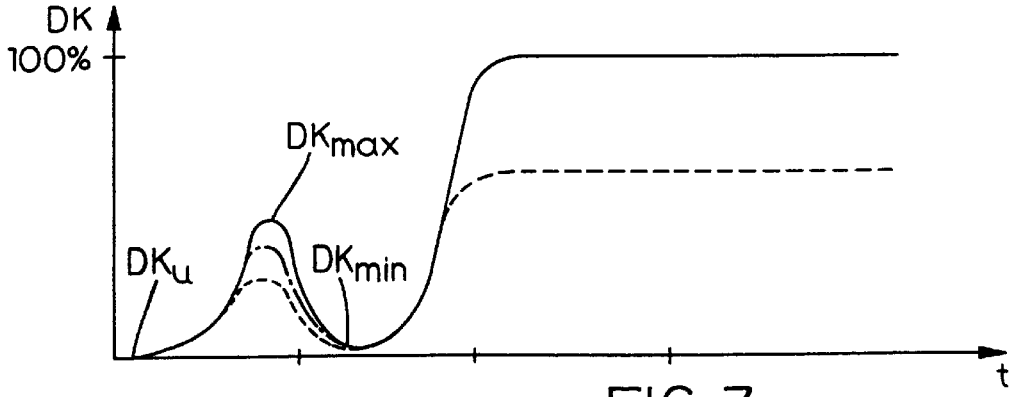
FIG. 3 shows the trend of the throttle valve position.

FIG. 3 shows the trend DK of the throttle valve position that occurs as a reaction to current function I. The trend DK rises to a local maximum $DK_{max}$ beginning from an initial closed position $DK_u$, then drops to a local minimum $D_{min}$, which lies at zero or a value slightly above zero, and finally rises to a target opening position $DK_o$, with which the final speed or target value for engine torque is achieved according to the end position of the gas pedal. The function of the throttle valve position is continuous up to the second derivative.

Figure 4:
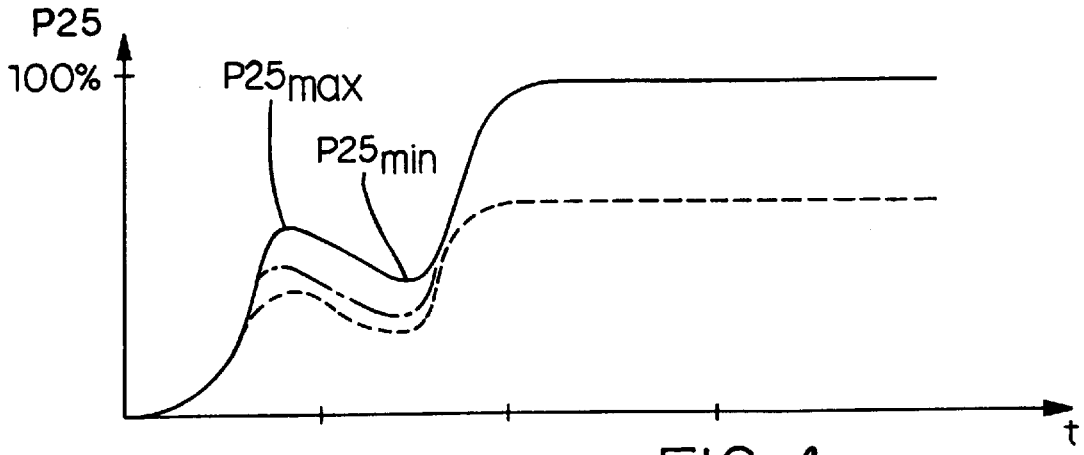
FIG. 4 shows the trend of the intake pressure.
Figure 5:
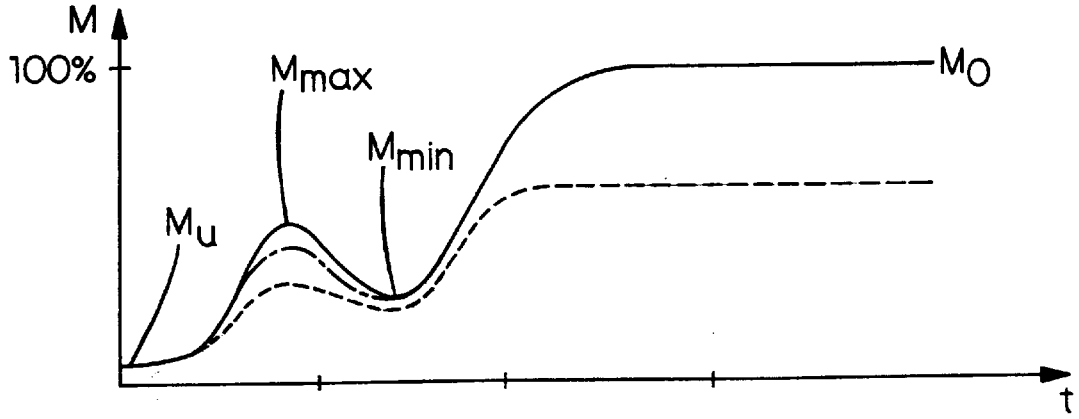
FIG. 5 shows the trend of the engine torque.

The trend of intake pressure $p_{2S}$ shown in FIG. 4 and the trend of engine torque M shown in FIG. 5 occur as a reaction to the change in throttle valve position. Both functions rise, like the current function I and the throttle valve position DK, starting from an initial value to a local maximum $p_{2Smax}$ and $M_{max}$, then fall to a local minimum $P_{2Smin}$ and $M_{min}$ and finally rise to a corresponding end value or target value. Depending on the driver's stipulation, local maxima and minima of different magnitudes are set with correspondingly different gradients, in which the qualitative trend remains essentially the same. The functions of intake pressure $P_{2S}$ and engine torque M are continuous, like the throttle valve function, up to the second derivative.

The time intervals between local maximum, local minimum and target value are advantageously adjusted to the oscillation period of the bucling oscillation. The time interval between the initial closed position of the throttle valve and the torque initial value and the target opening position and torque target value preferably amounts to ¼ to ½ of the oscillation period of the bucking oscillation, in which the precise value depends on the attainable gradient in the trend of the throttle valve position and in the trend of the engine torque. With very steep gradients, the time interval varies in the direction ¼, and with flatter gradients in the direction ½ of the oscillation time of the bucking oscillation. The duration of the local minimum in the trend of the throttle valve position and engine torque amounts to a maximum of ¼ of the oscillation time of the bucking oscillation with consideration of the criteria for the gradient.

The functions run from left to right for acceleration. During vehicle deceleration, the functions run in the opposite direction from right to left; the vehicle can be decelerated free of bucking accordingly.

What is claimed is:

1. A method of avoiding bucking oscillations during acceleration of a vehicle by influencing a position of a throttle valve of the vehicle as engine torque trends between a lower initial torque value and an upper target torque value by changing the position of the throttle valve between an initial closed position corresponding to the initial torque value and a target opening position corresponding to the target torque value wherein a trend of the throttle valve position has a local maximum that opens the throttle valve adjacent to the initial closed position and a local minimum that closes the throttle valve between a local maximum and the target opening position, setting the position of the throttle valve with an electrically actuated control element, controlling the trend of the throttle valve position by a current function that actuates the electrically actuated control element, the current function controlling the trend of the throttle valve position so that it rises to the local maximum from the initial closed position, then drops to the local minimum, and finally rises to the target opening position.

2. The method according to claim 1 wherein the current function has an irregularity to set the local maximum of the trend of the throttle valve position.

3. The method according to claim 1 wherein the current function is a rectangular current fiction.

4. The method according to claim 1 wherein the local minimum is zero.

5. The method according to claim 1 wherein a time interval between the initial closed position of the throttle valve and the target opening position of the throttle valve is ¼ to ½ of an oscillation time of the bucking oscillation.

6. The method according to claim 1 and further including the step of triggering change of the throttle valve position when a speed of a gas pedal of the vehicle is above a threshold value.

7. The method according to claim 6 wherein the threshold value is determined by at least one of the parameters of an initial position of the gas pedal, a gas pedal path difference, engine speed, and gear position.

8. A method according to claim 1 and further including the steps of determining, before beginning displacement of the throttle vale from a state quantity that describes an engine of the vehicle, a crude value of the upper target torque value to drive the throttle valve and correcting the actual target torque value in time-discrete intervals based on the state quantity.

9. The method according to claim 8 wherein the state quantity is a speed of a gas pedal of the vehicle.

* * * * *